US010203078B2

(12) United States Patent
Arai et al.

(10) Patent No.: US 10,203,078 B2
(45) Date of Patent: Feb. 12, 2019

(54) DAYLIGHTING STRUCTURE

(71) Applicant: MATERIAL HOUSE CO., LTD., Tokyo (JP)

(72) Inventors: Hideo Arai, Tokyo (JP); Akira Nogami, Tokyo (JP)

(73) Assignee: MATERIAL HOUSE CO., LTD., Tokyo (JP)

( * ) Notice: Subject to any disclaimer, the term of this patent is extended or adjusted under 35 U.S.C. 154(b) by 0 days.

(21) Appl. No.: 15/760,789

(22) PCT Filed: Aug. 23, 2016

(86) PCT No.: PCT/JP2016/074535

§ 371 (c)(1),
(2) Date: Mar. 16, 2018

(87) PCT Pub. No.: WO2017/061180

PCT Pub. Date: Apr. 13, 2017

(65) Prior Publication Data

US 2018/0259144 A1 Sep. 13, 2018

(30) Foreign Application Priority Data

Oct. 7, 2015 (JP) ..... 2015-199331

(51) Int. Cl.
*F21S 11/00* (2006.01)
*F21V 5/04* (2006.01)
(Continued)

(52) U.S. Cl.
CPC ..... *F21S 11/007* (2013.01); *F21S 11/00* (2013.01); *F21V 5/04* (2013.01); *F21V 7/0008* (2013.01); *F21V 13/04* (2013.01)

(58) Field of Classification Search
CPC ..... F21S 11/007; F21S 11/002
(Continued)

(56) References Cited

U.S. PATENT DOCUMENTS 631,220 A * 8/1899 Manning ..... E06B 9/24 359/596
5,461,496 A * 10/1995 Kanada ..... E06B 9/24 359/592

(Continued)

FOREIGN PATENT DOCUMENTS

JP 2000129792 A 5/2000
JP 2001060407 A 3/2001

(Continued)

OTHER PUBLICATIONS

International Search Report dated Nov. 29, 2016 for PCT/JP2016/074535 and English translation.

*Primary Examiner* — Christopher E Mahoney
(74) *Attorney, Agent, or Firm* — Lucas & Mercanti, LLP

(57) ABSTRACT

When daylighting into a building interior, this daylighting structure attenuates the brightness of a setting sun or a winter-time incoming light of small elevation angles, and causes the incoming light to be diffusely emitted toward the ceiling surface or into a deep portion of the indoor space domain regardless of the elevation angle thereof. An incoming light (E20) of 20° in elevation angle is caused to be diffusely emitted toward the ceiling surface on the internal upper side of the building through the refraction and reflection actions mediated by a light-transmitting material mounted in a horizontal direction opening of a wall. The light-transmitting material comprises: an outdoor region curved surface wherethrough the incoming light is refracted and let into the interior of the light-transmitting material in a focused form; a lower side reflection surface internally reflecting the refracted incoming light; and an indoor region curved surface wherefrom the internally reflected light is refracted and emitted toward the ceiling surface in a diffused form. Also disclosed are the installation wherein the light-transmitting material is inclined from the illustrated hori- (Continued)

zontal state, and the installation of a plurality of the light-transmitting materials, each in upper and lower directions and left and right directions.

5 Claims, 10 Drawing Sheets

(51) Int. Cl.
*F21V 7/00* (2006.01)
*F21V 13/04* (2006.01)

(58) Field of Classification Search
USPC ..... 359/595, 597–598
See application file for complete search history.

(56) References Cited

U.S. PATENT DOCUMENTS 5,802,784 A * 9/1998 Federmann ..... E06B 9/24 359/591
5,828,494 A * 10/1998 Stremple ..... G02B 5/045 359/615
2015/0022895 A1* 1/2015 Gommans ..... F21V 5/00 359/597
2015/0153013 A1* 6/2015 Wu ..... G02B 3/005 359/361

FOREIGN PATENT DOCUMENTS

JP 2004363042 A 12/2004
JP 2009266794 A 11/2009
JP WO 2012169356 A1 * 12/2012 ..... F21S 11/007
WO 2014078812 A1 5/2014
WO 2015119071 A1 8/2015

* cited by examiner (a)

(b) planar state (a)

(b) planar state

DAYLIGHTING STRUCTURE

CROSS REFERENCE TO RELATED APPLICATION

This Application is a 371 of PCT/JP2016/074535 filed on Aug. 23, 2016, which, in turn, claimed the priority of Japanese Patent Application No. 2015-199331 filed on Oct. 7, 2015, both applications are incorporated herein by reference.

TECHNICAL FIELD

The present invention relates to a daylighting structure formed of a light-transmitting material that is attached to a daylighting portion such as a high window of a building and diffusely propagates an incident light from an outside toward a ceiling surface of a building interior.

The present invention particularly relates to a daylighting structure using a light-transmitting material formed of an outdoor region curved surface in which the incident light is refracted and incident in a focused form, a lower side reflection surface internally reflecting the refracted incident light, and an indoor region curved surface from which the internally reflected light is refracted and emitted toward the indoor ceiling surface in a diffused form, as the light-transmitting material for light propagating.

The lower side reflection surface and the like are made to be mirror surfaces. This reliably prevents a state where the refracted incident light in the outdoor region curved surface is refracted also in this lower side reflection surface and advances to a lower region of the light-transmitting material.

The light-transmitting material is rotated around the longitudinal axis thereof and is held in the position. Thereby, a diffused and emitted light area toward the indoor ceiling surface side can appropriately shift to a depth direction.

In daylighting to a building interior, it may be desirable to attenuate the brightness of a winter-time incident light or a setting sun of small elevation angles with respect to a person in the building interior, and cause the incident light to be diffused and emitted toward the ceiling surface or into a deep portion of the indoor space region regardless of the elevation angle thereof. The present invention responds to such demand.

BACKGROUND ART

A conventional daylighting structure that intakes an incident sunlight from a window part, to an indoor ceiling surface by a reflection effect in an upper surface of a light shelf attached to an outside of a building window part in a horizontal state, has been suggested (for example, Patent Document 1 described below).

In this daylighting structure, a plurality of prism surface materials are placed side by side in a vertical direction in an upper inside of the building window part. Thereby, generally, a summer-time daylight is reflected to the outside and spring-time, autumn-time, and winter-time daylights are refracted to an indoor upper space region including the ceiling surface.

CITATION LIST

Patent Literature

Patent Literature 1: Japanese patent application publication No. 2001-60407

SUMMARY OF THE INVENTION

Technical Problem

In the conventional daylighting structure described above, the spring-time, autumn-time, and winter-time incident sunlight are advanced to the indoor upward space region only by a light reflection effect and a light refraction effect in plain surface parts of the light shelf and the prism surface materials.

Thus, the refracted and emitted light advancing from the prism surface materials to the indoor upward space region is a so-called bundle of parallel lights. Therefore, there is a problem that a person in the indoor cannot expect a feeling of diffusion of the refracted and emitted light to the ceiling surface direction and the indoor depth direction.

The present invention has an object to diffuse the emitted light to the indoor by configuring so that the incident light is refracted and incident in a focused form from the outdoor region curved surface of the light-transmitting material and an internally reflected light in a lower side reflection surface thereof is refracted and emitted in a diffused form from the indoor region curved surface of the light-transmitting material to the indoor ceiling surface and the indoor deep portion.

The present invention also has an object to reliably and efficiently diffuse the emitted light to the indoor by setting the lower side reflection surface and the like to be mirror surfaces and preventing the refracted incident light in the outdoor region curved surface from, in a sense, exiting downward from the lower side reflection surface.

The present invention also has an object to make use modes as the daylighting structure selectable and diversified by configuring so that the light-transmitting material is rotated and held around the longitudinal axis thereof and a diffused and emitted light area toward the ceiling surface side of the indoor space region can appropriately shift to a depth direction.

Solution to Problem

The present invention solves the problems described above, in the following manner.

(1) In a daylighting structure formed of a light-transmitting material (for example, a light-transmitting material 1 described later) that is attached to a daylighting portion (for example, an opening part in a horizontal direction described later) of a building (for example, a building 2 described later) and propagates an incident light from the outside toward a ceiling surface (for example, a ceiling surface 2*b* described later) of a building interior, the light-transmitting material includes:

an upper side incidence and emission curved surface (for example, an upper side incidence and emission curved surface 1*a* described later) that is formed of an outdoor region curved surface (for example, an outdoor region curved surface 1*b* described later) in which the incident light is refracted and incident to the inside of the light-transmitting material in a focused form, and an indoor region curved surface (for example, an indoor region curved surface 1*c* described later) from which an internally reflected light of the refracted incident light is refracted and emitted toward the ceiling surface in a diffused form, the upper side incidence and emission curved surface extending in a longitudinal direction of the light-transmitting material in a state of projecting upward from an end portion toward a center side of a width direction of the light-transmitting material; and a lower side reflection surface (for example, a lower side reflection surface 1*d* described later) in which the refracted incident light reflects and changes to the internally reflected light advancing to the indoor region curved surface of the upper side incidence and emission curved surface, the lower side reflection surface extending in the longitudinal direction of the light-transmitting material.

(2) In (1) described above,
the upper side incidence and emission curved surface
has an arc-shaped longitudinal section in the width direction of the light-transmitting material.

(3) In (1) and (2) described above,
the lower side reflection surface
has a mirror surface portion for generating the internally reflected light.

(4) In (1) to (3) described above,
the light-transmitting material
has a mirror portion for generating the internally reflected light in a side surface (for example, an orthogonal side surface 1*e*, and a folded side surface 1*e*' described later) of the longitudinal direction of the light-transmitting material.

(5) In (1) to (4) described above,
the light-transmitting material
is attached to the daylighting portion in a rotatable form around the longitudinal axis thereof.

(6) In (1) to (5) described above,
the daylighting portion
is installed with a plurality of the light-transmitting materials facing sideways with an interval of a predetermined value or more between the upper side incidence and emission curved surface and the lower side reflection surface that is upper than the upper side incidence and emission curved surface, that are adjacent in the vertical direction.

The present invention is directed to a daylighting structure having the configuration described above.

Advantageous Effects of Invention

The present invention can, by the means for solving the problem described above,

(11) attenuate the brightness of a winter-time incident light or a setting sun of small elevation angles with respect to a person in the building interior, in daylighting to a building interior,

(12) cause the incident light to be diffused and emitted toward a ceiling surface or into a deep portion of an indoor space region regardless of the elevation angle of the incident light,

(13) reliably and efficiently diffuse an emitted light to an indoor by preventing a refracted incident light in an outdoor region curved surface from, in a sense, exiting downward from a lower side reflection surface, and

(14) make use modes as the daylighting structure selectable and diversified by configuring so that a diffused and emitted light area toward a ceiling surface side of the indoor space region can appropriately shift to a depth direction.

BRIEF DESCRIPTION OF DRAWINGS

FIG. 1 is an explanatory drawing showing an overview of an incident sunlight to a light-transmitting material attached to a wall near a high window of a building, a diffuse emission light area in the indoor thereof, and the like.

DESCRIPTION OF EMBODIMENTS

Figure 1:
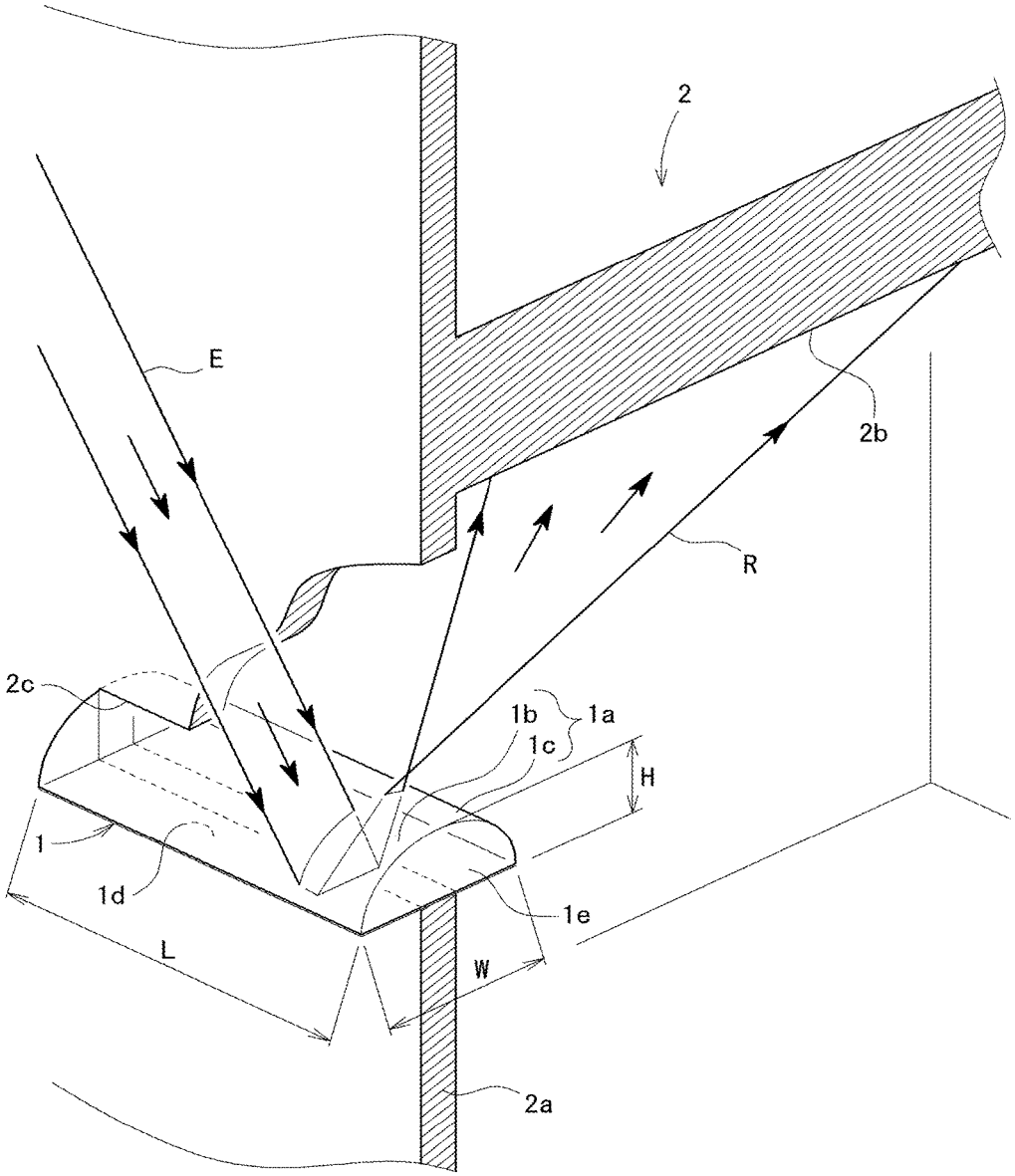

Embodiments of a daylighting device according to the present invention is described with reference to FIG. 1 to FIG. 10.

A component having a reference numeral with an alphabet in FIG. 1 to FIG. 10 (for example, the upper side incidence and emission curved surface 1*a*) indicates that it is a part of a component of a numeral portion of the reference numeral (for example, the light-transmitting material 1), in principle.

In FIG. 1 to FIG. 10,

1 is a light-transmitting material formed of acrylic resin, glass, or the like, and having a semi-cylindrical hog-backed shape,

1*a* is an upper side incidence and emission curved surface formed of a curved surface that projects upward, having a semi-circular longitudinal section in a width direction of the light-transmitting material, and extending in a longitudinal direction of the light-transmitting material,

1*b* is an outdoor region curved surface forming an outer half of the width direction of the light-transmitting material of the upper side incidence and emission curved surface 1*a* and having a longitudinal section of a ¼ circular shape,

1*c* is an indoor region curved surface forming an inner half of the width direction of the light-transmitting material of the upper side incidence and emission curved surface 1*a* and having a longitudinal section of a ¼ circular shape,

1*d* is a lower side reflection surface formed of a planer surface, extending in the longitudinal direction of the light-transmitting material, and is a mirror surface,

1*e* are both end portions of the longitudinal direction of the light-transmitting material, and are orthogonal side surfaces in the width direction of the light-transmitting material that is orthogonal to the longitudinal direction of the light-transmitting material, having a single planer mirror surface, 1*e*' are both end portions of the longitudinal direction of the light-transmitting material, and are folded side surfaces having a planer view in which a center part of a width direction projects to be an "inverted V-shape", having two planer mirror surfaces, and projecting outward (see FIG. 10), and

Figure 6:
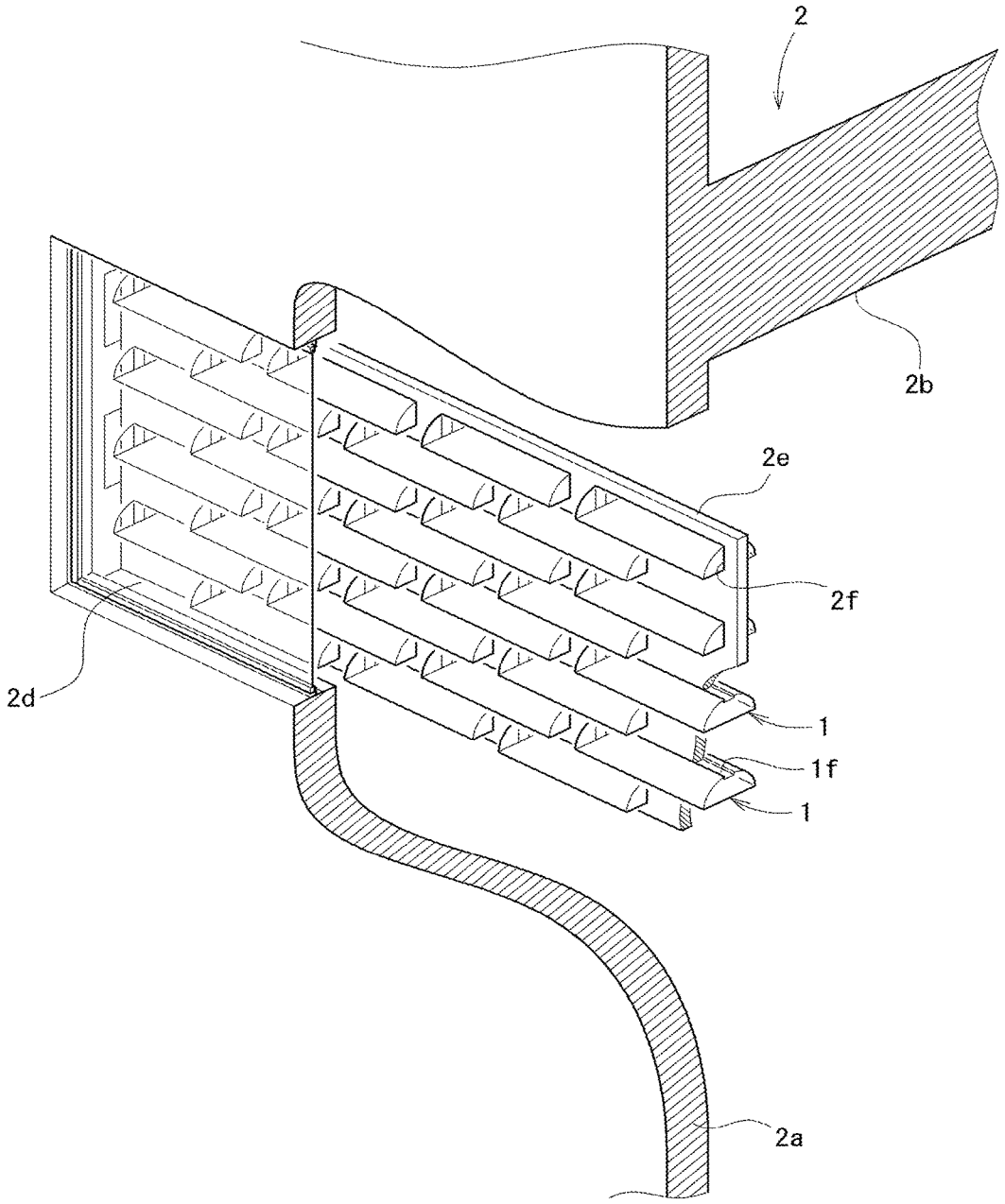
FIG. 6 is an explanatory drawing showing a multi-daylighting structure in a form where each of 28 in total of laterally long holes of a rectangular substrate is incorporated with the light-transmitting material.

1*f* is a lateral groove part formed in the longitudinal direction of the light-transmitting material of a top part of the upper side incidence and emission curved surface 1*a*, and, in a state of being incorporated in a laterally long hole 2*f* of a rectangular substrate 2*e*, exhibits a positioning effect with respect to the substrate (see FIG. 6).

The mirror surfaces of the lower side reflection surface 1*d*, the orthogonal side surfaces 1*e*, and the folded side surfaces 1*e'* are formed by, for example,

(21) depositing a silver or an aluminum,

(22) adhering a mirror surface material, or

(23) placing on a mirror surface or the like.

Figure 7:
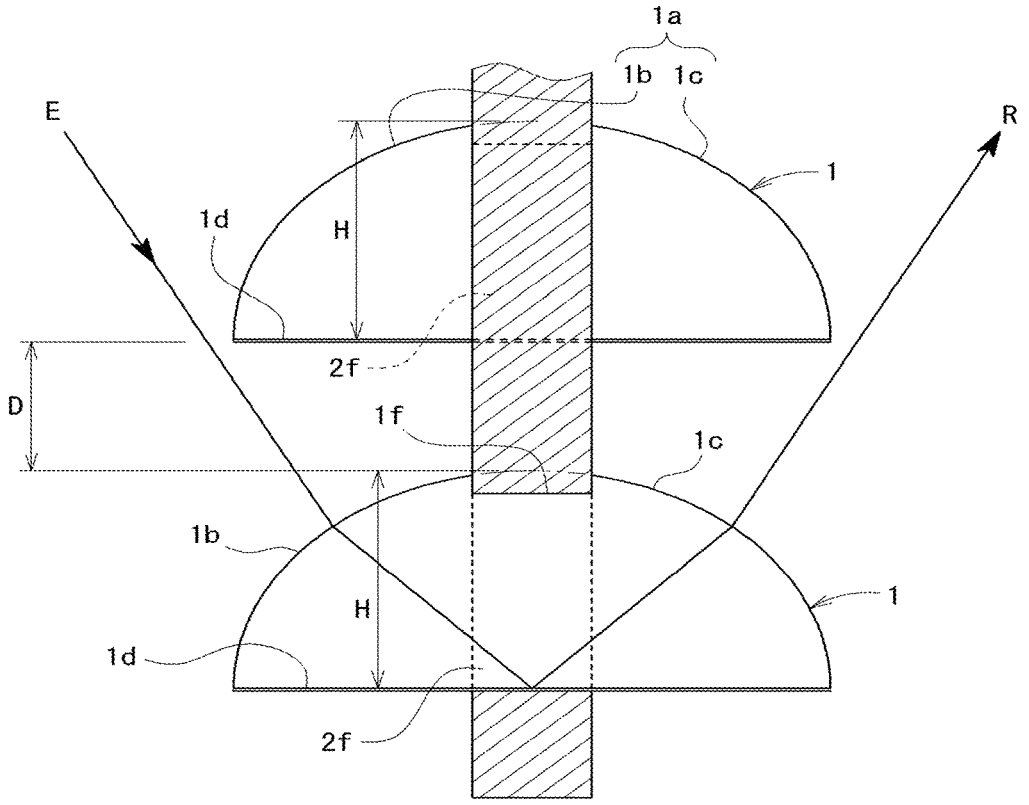
FIG. 7 is an explanatory drawing showing a state where, when the light-transmitting materials are placed side by side vertically, the light-transmitting materials are spaced apart from each other by an interval D.

L is a length of the longitudinal direction (axial direction) of the light-transmitting material 1, W is a width of the lower side reflection surface 1*d* (length of a direction that is orthogonal to the longitudinal direction of the light-transmitting material), H is a height from the lower side reflection surface 1*d* to a top part of the upper side incidence and emission curved surface 1*a* (=W/2), S and T are rotational direction when the light-transmitting material 1 in a horizontal state is installed by being rotated by ±10° around the longitudinal axis of the light-transmitting material 1 (see FIG. 5), and D is an interval between the light-transmitting materials 1 that are adjacent vertically when the light-transmitting materials 1 are placed side by side in plural stages (see FIG. 7).

2 is a building to be installed with the light-transmitting material 1,

2*a* is a wall installed with the light-transmitting material,

2*b* is a ceiling surface that is a diffusion and emission target region of the light-transmitting material 1,

2*c* is an opening part in a horizontal direction formed horizontally with the wall 2*a* and serving as a daylighting portion attached with the light-transmitting material 1,

2*d* is a high window formed in the wall 2*a* (see FIG. 6),

2*e* is a rectangular substrate set in the inside of the high window 2*d*, holding the plurality of light-transmitting materials 1 independently, and formed of a vertical wood, and

2*f* are laterally long hole parts for attachment of the light-transmitting material formed so that "4-3-4-3-4-3-4-3" pieces sequentially of the hole parts are formed in 8 lines from upper end side of the rectangular substrate 2*e* downwardly, and a line having "4" pieces of the hole parts and a line having "3" pieces of the hole parts are laterally shifted from each other by ½ of the length L of the light-transmitting material (see FIG. 6).

E is an incident light to the outdoor region curved surface 1*b* of the upper side incidence and emission curved surface 1*a*, R is a diffuse emission light from the indoor region curved surface 1*c* with respect to the incident light E, E' is a refracted incident light formed by the incident light E being refracted in the outdoor region curved surface 1*b* and being incident to the orthogonal side surface 1*e* having a mirror surface, in a focused form, and R' is a diffuse emission light formed by the refracted incident light E' reflecting in the orthogonal side surface 1*e* and the lower side reflection surface 1*d* and emitting from the indoor region curved surface 1*c* in a refracted state.

Figure 2:
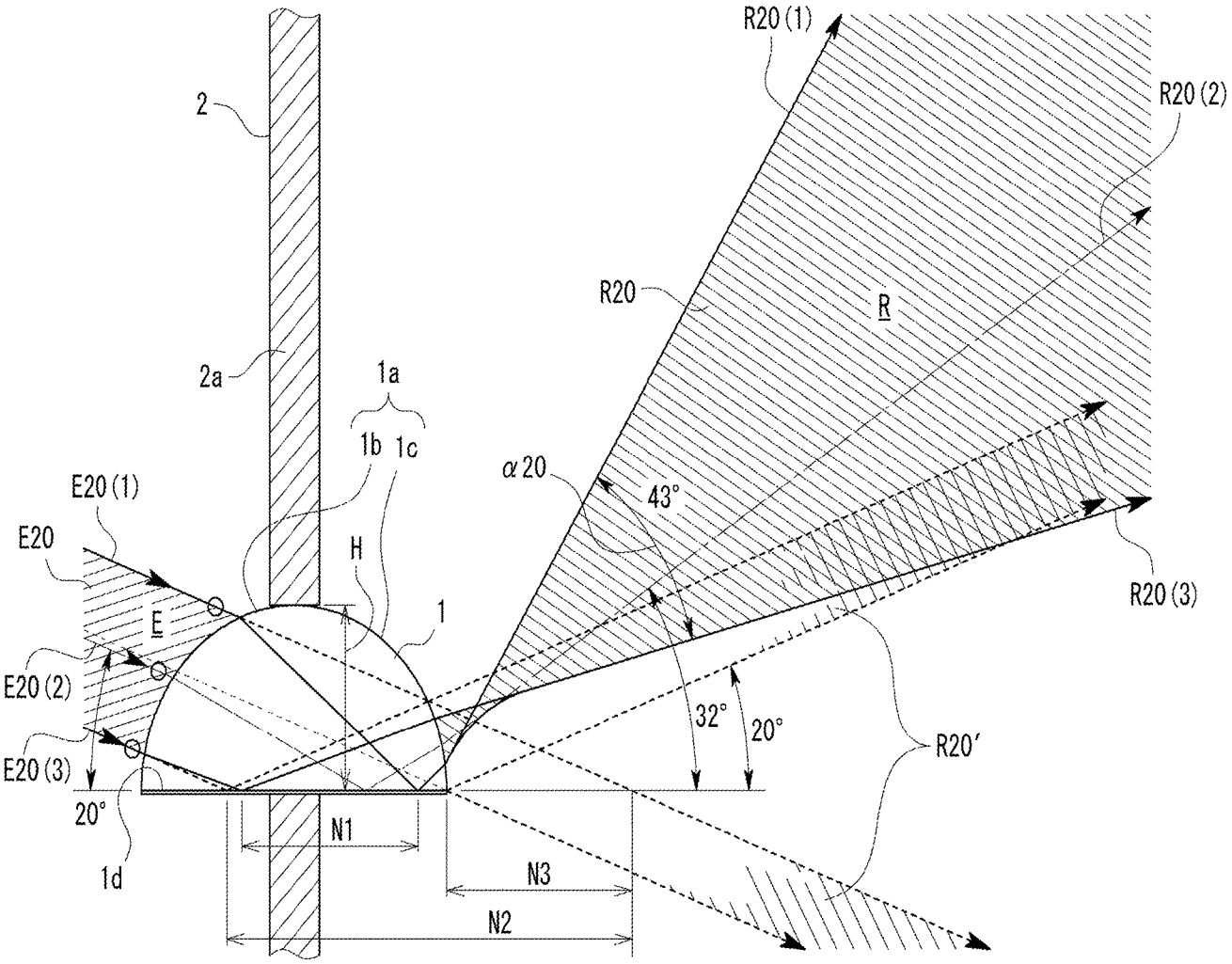
FIG. 2 is an explanatory drawing showing an incident sunlight of the elevation angle of 20°, and a diffuse emission light area thereof in the indoor.

In FIG. 2,

E20 is an incident light of an elevation angle of 20° to the outdoor region curved surface 1*b*, E20(1) is an upper end incident light beam composing a so-called upper end side of the incident light E20, E20(2) is a boundary incident light beam formed by the incident light E20 reaching an end part of the indoor side when it is assumed that the incident light E20 does not refract and advances to the lower side reflection surface 1*d*, E20(3) is a lower end incident light beam composing a so-called lower end side of the incident light E20, R20 is a diffuse emission light area from the indoor region curved surface 1*c*, with respect to the incident light E20, R20(1) to R20(3) are emission light beams from the indoor region curved surface 1*c*, with respect to the incident light beams of E20(1) to E20(3), respectively, R20' is a reflected light area with respect to the incident light E20 when only the lower side reflection surface 1*d* is used instead of the light-transmitting material 1, and α20 is a diffusion angle of the diffuse emission light area R20.

Regarding a so-called crossing range of the incident light E20 with respect to a horizontal surface formed of the lower side reflection surface 1*d* and a virtual extension surface of the lower side reflection surface 1*d* in the width direction of the light-transmitting material, N1 is a small crossing range of an infracted incident light "with the upper side incidence and emission curved surface 1*a*", N2 is a large crossing range of a straight incident light "without the upper side incidence and emission curved surface 1*a*", and N3 is an outward crossing range dominating a range that is within the large crossing range N2 and is an indoor side outward from the lower side reflection surface 1*d*.

Figure 3:
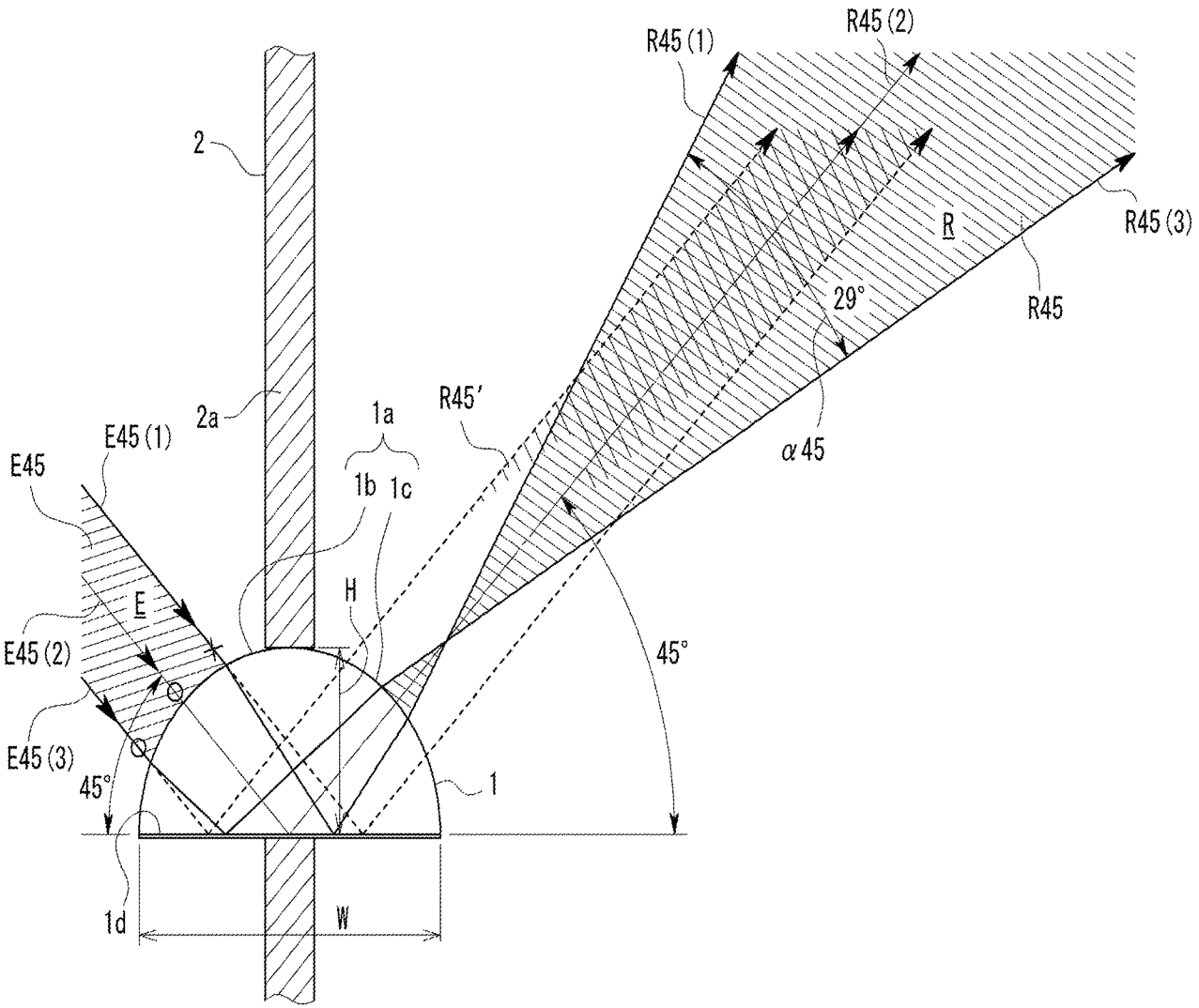
FIG. 3 is an explanatory drawing showing an incident sunlight of the elevation angle of 45°, and a diffuse emission light area thereof in the indoor.
Figure 5:
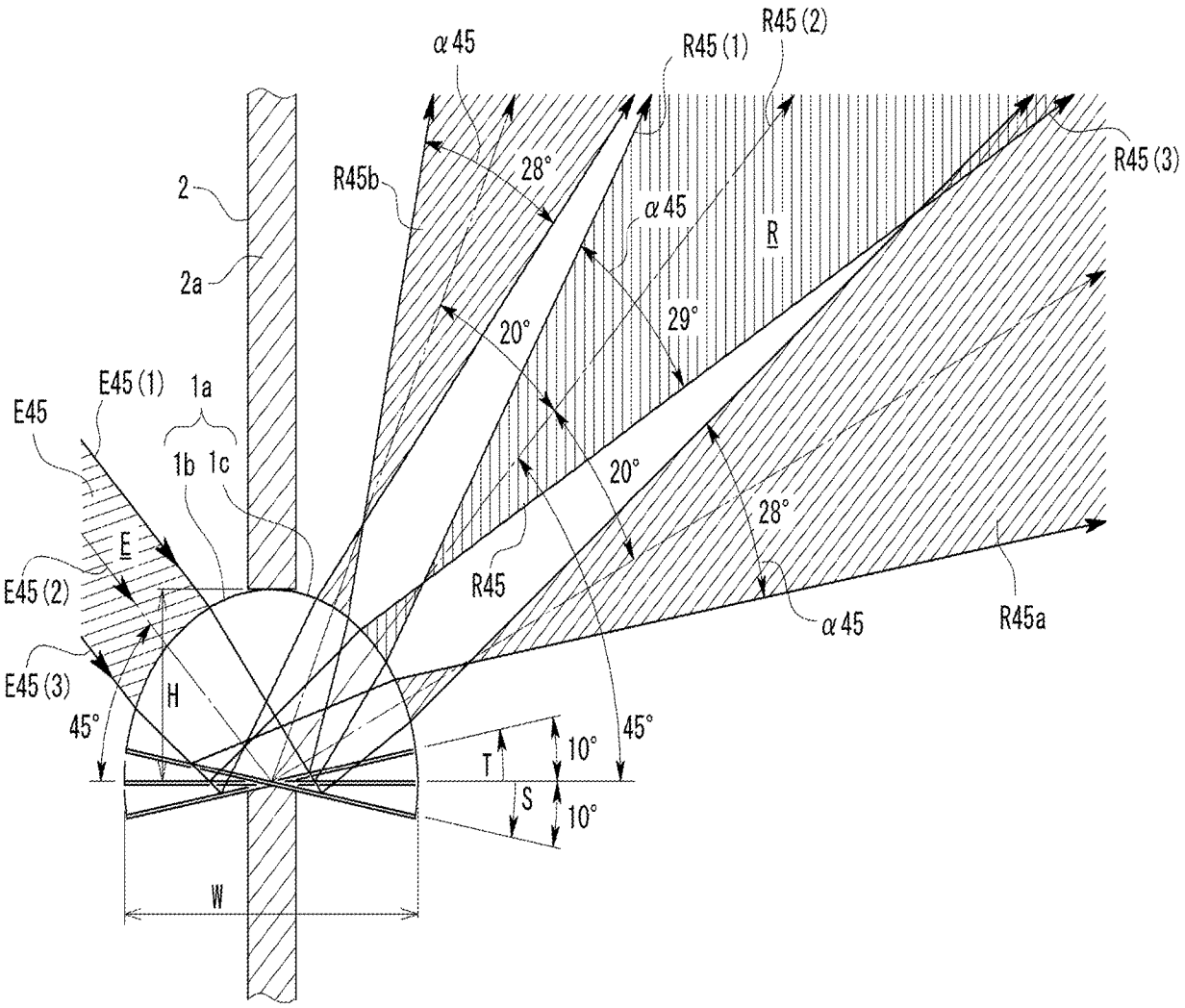
FIG. 5 is an explanatory drawing showing a shift state of the diffuse emission light area with respect to the incident sunlight of the elevation angle of 45° when the light-transmitting material in FIG. 3 is installed in a state of being rotated by ±10° around a longitudinal axis passing an intermediate portion of a lower side reflection surface width direction.

In FIG. 3 and FIG. 5,

E45 is an incident light of an elevation angle of 45° to the outdoor region curved surface 1*b*, E45(1) is an upper end incident light beam of the incident light E45, E45(2) is an intermediate incident light beam in the vertical direction of the incident light E45, E45(3) is a lower end incident light beam of the incident light E45, R45 is a diffuse emission light area from the indoor region curved surface 1*c* with respect to the incident light E45, R45(1) to R45(3) are emission light beams from the indoor region curved surface 1*c* with respect to the incident light beams of E45(1) to E45(3), respectively, R45' is a reflected light area with respect to the incident light E45 when only the lower side reflection surface 1*d* is used instead of the light-transmitting material 1, R45*a* is a diffuse emission light area from the indoor region curved surface 1*c* with respect to the incident light E45 when the light-transmitting material 1 horizontally set is rotated by approximately 10° in an S direction (clockwise direction shown in the drawing) of the indoor side around the longitudinal axis of the light-transmitting material 1, R45*b* is a diffuse emission light area from the indoor region curved surface 1*c* with respect to the incident light E45 when the light-transmitting material 1 horizontally set is rotated by approximately 10° in a T direction (counterclockwise direction shown in the drawing) of the outdoor side around the longitudinal axis of the light-transmitting material 1, and α45 are diffusion angles of the diffuse emission light areas R45, R45*a*, and R45*b*.

Figure 4:
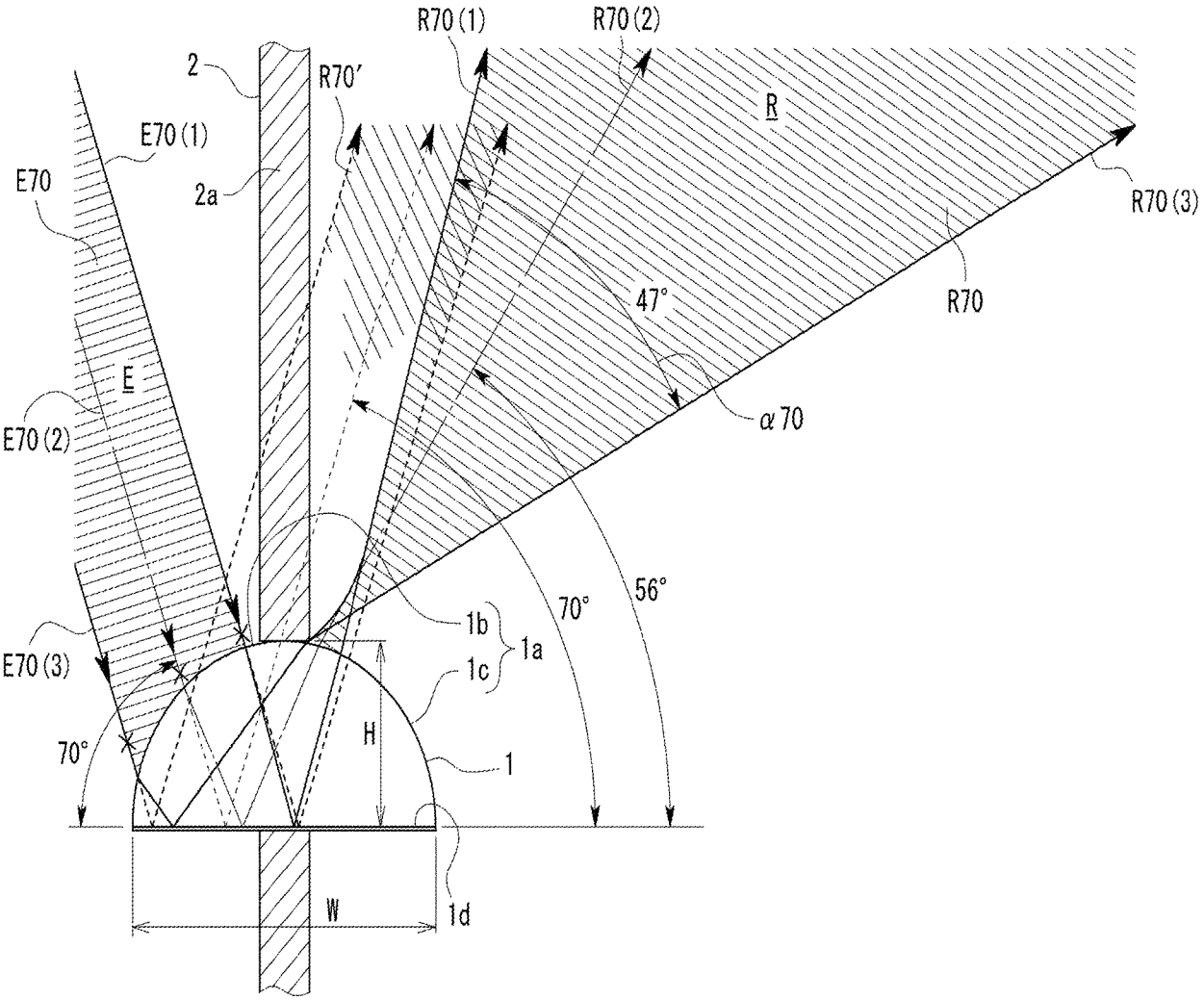
FIG. 4 is an explanatory drawing showing an incident sunlight of the elevation angle of 70°, and a diffuse emission light area thereof in the indoor.

In FIG. 4,

E70 is an incident light of an elevation angle of 70° to the outdoor region curved surface 1*b*, E70(1) is an upper end incident light beam of the incident light E70, E70(2) is an intermediate incident light beam in the vertical direction of the incident light E70, E70(3) is a lower end incident light beam of the incident light E70, R70 is a diffuse emission light area from the indoor region curved surface 1*c* with respect to the incident light E70, R70(1) to R70(3) are emission light beams from the indoor region curved surface 1*c* with respect to the incident light beams of E70(1) to E70(3), respectively, R70' is a reflected light area with respect to the incident light E70 when only the lower side reflection surface 1*d* is used instead of the light-transmitting material 1, and α70 is a diffusion angle of the diffuse emission light area R70.

Only as an example, the length L, width W, and height H (see FIG. 1) of the light-transmitting material 1 and the interval D between vertically adjacent light-transmitting materials 1 (see FIG. 7) are L: 300 mm W: 34 mm H: 17 mm, and D: 17 mm.

Basic characteristics of the daylighting structure shown in the drawings is as follows. In a state where the light-transmitting material 1 is set so that a semi-cylindrical bottom surface of the light-transmitting material 1 is substantially horizontal to the wall 2*a* of the building 2,

(31) direct sunlight (incident lights E20, E45, E70, and the like) as a parallel incident light is incident in the outdoor region curved surface 1*b* of the upper side incidence and emission curved surface 1*a* and is refracted to a direction advancing to the lower side reflection surface 1*d*,

(32) this refracted incident light reflects in the lower side reflection surface 1*d*, and

(33) this reflected light is refracted in the indoor region curved surface 1*c* of the upper side incidence and emission curved surface 1*a* and is diffused and emitted to the ceiling surface 2*b* of the building 2 and a deep portion of the indoor space region.

In this way, the daylighting structure shown in the drawings is configured so that the direct sunlight (incident lights E20, E45, E70, and the like) does not advance straight to the lower side reflection surface 1*d*, but, first, is refracted in the upper side incidence and emission curved surface 1*a*, and then the refracted incident light advances to the lower side reflection surface 1*d*.

By the refraction effect of (31) described above, compared to when this upper side incidence and emission curved surface 1*a* is not set, that is, when only the lower side reflection surface 1*d* is provided, most incident lights E (substantially all of them) advance in a direction that is the lower side reflection surface 1*d*.

That is, the direct sunlight as a parallel light is refracted in a focused form in the outdoor region curved surface 1*b*, and thereby, an incident light part (see an outward crossing range N3 in FIG. 2) that exits from the outside of the lower side reflection surface 1*d* to the indoor lower region in a straight advancing environment without that refraction, is minimized.

This effect of preventing the incident light to the outdoor region curved surface 1*b* of the light-transmitting material 1 from deviating from the lower side reflection surface 1*d* and exiting to the indoor lower region, by the incident light refraction in the outdoor region curved surface 1*b* is effective to the incident light of a smaller elevation angle.

For example, in a case of the incident light E20 in FIG. 2 a so-called crossing range of the width direction of the light-transmitting material in a lower side reflection surface 1*d* and the horizontal surface formed of the virtual extension surface of the lower side reflection surface 1*d* is the small crossing range N1 when the range is "with the upper side incidence and emission curved surface 1*a*" and is the large crossing range N2 when the range is "without the upper side incidence and emission curved surface 1*a*".

The incident light portion of "E20(1) to E20(2)" that is incident in the outward crossing range N3 that is the outward region of the lower side reflection surface 1*d* in the right-side portion shown in the drawings of the large crossing range N2 "without the upper side incidence and emission curved surface 1*a*", advances to the indoor lower space region in the lower side reflection surface outward region without being reflected by the lower side reflection surface 1*d*.

On the other hand, in a case of the incident light E20 in FIG. 2 in installation of the light-transmitting material 1, the crossing range of the width direction of the light-transmitting material in the horizontal surface including the lower side reflection surface 1*d* is within the lower side reflection surface 1*d* and does not come out to the outward region therefrom, by the refraction effect of the upper side incidence and emission curved surface 1*a*.

Thus, the whole incident light of "E20(1) to E20(3)" in FIG. 2 to the outdoor region curved surface 1*b* reflects in the lower side reflection surface 1*d*, advances to the indoor region curved surface 1*c* of the upper side incidence and emission curved surface 1*a*, and is diffused and emitted to the ceiling surface 2*b* by the re-refraction in the indoor region curved surface 1*c*.

Also in a case of the incident lights E45 and E70 of the elevation angles of 45° and 70°, respectively, as is clear from FIG. 3 and FIG. 4, the whole of the incident lights is refracted in the outdoor region curved surface 1*b*, and then advances to the lower side reflection surface 1*d*, and the reflected light in the lower side reflection surface 1*d* is diffused and emitted from the indoor region curved surface 1*c* to the ceiling surface 2*b*.

So-called diffusion angles α20, α45, α70 of the diffuse emission light areas R20, R45, R70 from the indoor region curved surface 1*c* of the incident lights E20, E45, E70 in FIG. 2 to FIG. 4 are, for example, "α20=43°, α45=29°, and α70=47°".

The diffuse emission light area R20 with respect to the incident light E20 in FIG. 2 is set to sequentially spread to the ceiling surface portion near the wall 2*a* more than the reflected light area R20' of a case where only the lower side reflection surface 1*d* is used instead of the light-transmitting material 1.

The diffuse emission light area R45 with respect to the incident light E45 in FIG. 3 is set to sequentially spread to both of the ceiling surface portion near the wall 2*a* and the ceiling surface portion far from the wall 2*a*, more than the reflected light area R45' of a case where only the lower side reflection surface 1*d* is used instead of the light-transmitting material 1.

The diffuse emission light area R70 with respect to the incident light E70 in FIG. 4 is set to sequentially spread to the ceiling surface portion that is far from the wall 2*a* more than the reflected light area R70' of a case where only the lower side reflection surface 1*d* is used instead of the light-transmitting material 1.

Note that although the lower side reflection surface 1*d* shown in the drawings has a mirror surface, the mirror surface may not be set when a main target of the daylighting is an incident light of a small elevation angle such as a setting sun.

This is because, for example, the incident light E20 (elevation angle 20°) that is refracted in the outdoor region curved surface 1*b* and advances to the lower side reflection surface 1*d* reflects entirely in the lower side reflection surface. That is, in the incident light E20, an incident light beam being refracted in the lower side reflection surface 1*d* and advancing to the lower region of the lower side reflection surface 1*d*, is not generated.

The state of the entire reflection in the lower side reflection surface 1*d* for the incident lights E20, E45, and E70 in FIG. 2, FIG. 3, and FIG. 4 is approximately as follows.

(41) In a case of FIG. 2 of an elevation angle 20°, each of the upper end incident light beam E20(1), a boundary incident light beam E20(2), and the lower end incident light beam E20(3) reflects entirely.

(42) In a case of FIG. 3 of an elevation angle 45°, the upper end incident light beam E45(1) does not reflect entirely and an intermediate incident light beam E45(2) and the lower end incident light beam E45(3) reflect entirely.

(43) In a case of FIG. 4 of an elevation angle 70°, each of the upper incident light beam E70(1), an intermediate incident light beam E70(2), and the lower end incident light beam E20(3) does not reflect entirely.

The whole incident and refracted light beams between the incident light beams of the entire reflection, for example, between the upper end incident light beam E20(1) and the boundary incident light beam E20(2), reflects entirely in the lower side reflection surface 1*d* similarly.

Among the incident lights to the outdoor region curved surface 1*b* in FIG. 2 to FIG. 4, the incident lights reflecting entirely in the lower side reflection surface 1*d* are shown as "circle" and those not reflecting entirely is shown as "X".

Whether the incident light to the lower side reflection surface 1*d* reflects entirely is determined by, as is known, the magnitude relation between an incident angle of the incident light and a critical angle of the light-transmitting material 1 (lower side reflection surface). The incident light having an incident angle that is larger than the critical angle, reflects entirely.

The critical angle itself is an angle based on refraction indices of both medium in the boundary portion where the light is refracted. In a case of the light-transmitting material 1 formed of an acrylic resin (refraction index=1.49) and an air space (refraction index≈1.00), shown in the drawings, the critical angle of the incident light of "from the lower side reflection surface 1*d* to the air space" is approximately "42.14°".

When the light-transmitting material 1 formed of a glass (refraction index=1.52) is used, the critical angle of the incident light of "from the lower side reflection surface 1*d* to the air space" is approximately "41.14°".

The daylighting structure using the light-transmitting material 1 shown in the drawings can, in the indoor,

(51) attenuate the brightness of a winter-time incident light or a setting sun of a small elevation angle, and

(52) cause the incident light to be diffusely propagated toward the ceiling surface 2*b* and a deep portion of the indoor space region regardless of the elevation angle of the incident light.

FIG. 5 shows a shift state of the diffuse emission light area with respect to the incident light E45 when the light-transmitting material 1 so-called horizontally installed in FIG. 3 is rotated by ±10° around a longitudinal axis passing an intermediate portion of the width direction of the lower side reflection surface.

When the light-transmitting material 1 in FIG. 3 is rotated by 10° in an S direction (clockwise direction shown in the drawing), the diffuse emission light area with respect to the incident light E45 shifts from R45 to R45*a* that is the deeper side. When the light-transmitting material 1 is rotated by 10° in a T direction (counterclockwise direction shown in the drawing), the diffuse emission light area shifts from R45 to R45*b* that is the wall side.

By such rotation installation of the light-transmitting material 1, a depth range of the diffuse emission light area from the indoor region curved surface 1*c*, and the like can be selected.

In a state where the light-transmitting material 1 horizontally installed is rotated by ±10° around the longitudinal direction axis described above, the diffusion angle is approximately "28°".

Although not clearly shown in the drawing, a projection part or a convex part that continues from an intermediate portion of a width direction of a bottom surface of the lower side reflection surface 1*d* to a direction of a length L is formed as the longitudinal axis. A bottom surface portion of the opening part in the horizontal direction 2*c* is formed with, a convex part or a projection part that receives the longitudinal axis in a rotatable manner.

In the ceiling surface portion of the opening part in the horizontal direction 2*c*, elements that hold the light-transmitting material 1 in the rotation position are set.

The elements are, for example, holding parts such as a friction effect part acting with the upper side incidence and emission curved surface 1*a* of the light-transmitting material 1 and an optional engaged part formed on the upper side incidence and emission curved surface 1*a*.

FIG. 6 shows a multi-daylighting structure in a form where each of 28 in total of laterally long holes 2*f* of a rectangular substrate 2*e* is incorporated with the light-transmitting material 1.

Each of the lateral groove part 1*f* of each light-transmitting material 1 is positioned so as to engage with an upper side edge portion of each of the laterally long holes 2*f* in the rectangular substrate 2*e*.

FIG. 7 shows a state where, when the light-transmitting materials 1 are placed side by side vertically, the light-transmitting materials are proactively spaced apart from each other by an interval D.

The interval D is secured in the vertical arrangement of the light-transmitting materials 1, and thereby, a state where the emission light from the indoor region curved surface 1*c* of the lower side light-transmitting material hits the lower side reflection surface 1*d* of the upper side light-transmitting material and cannot advance to the ceiling surface 2*b*, is prevented.

Figure 8:
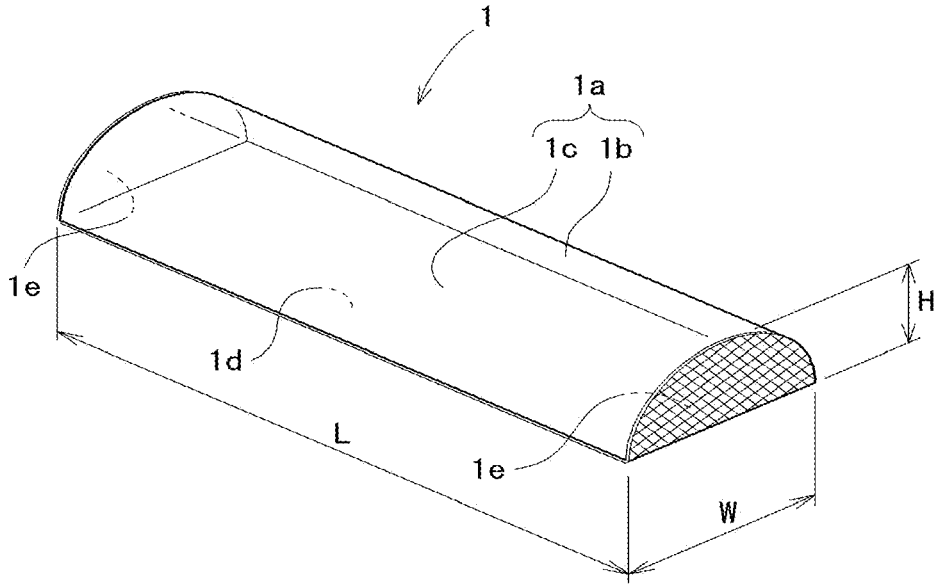
FIG. 8 is an explanatory drawing showing a situation where an infracted incident light E' reflects in an orthogonal side surface and a lower side reflection surface that are mirror surfaces, and then advances from the indoor region curved surface to a ceiling surface as a diffuse emission light R'. (a) shows a perspective state and (b) shows a planar state.
Figure 8:
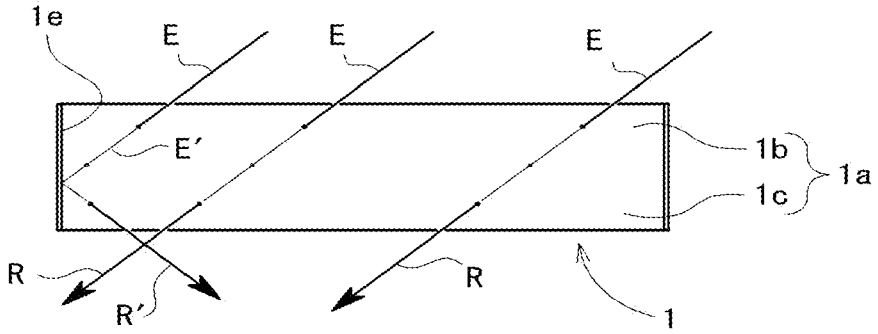

FIG. 8 shows a situation where the infracted incident light E' that is a part of the refracted light in the outdoor region curved surface 1*b* of the incident light E, reflects in the orthogonal side surface 1*e* and the lower side reflection surface 1*d* that are mirror surfaces, and then advances from the indoor region curved surface 1*c* to the ceiling surface 2*b* as the diffuse emission light R'.

Figure 9:
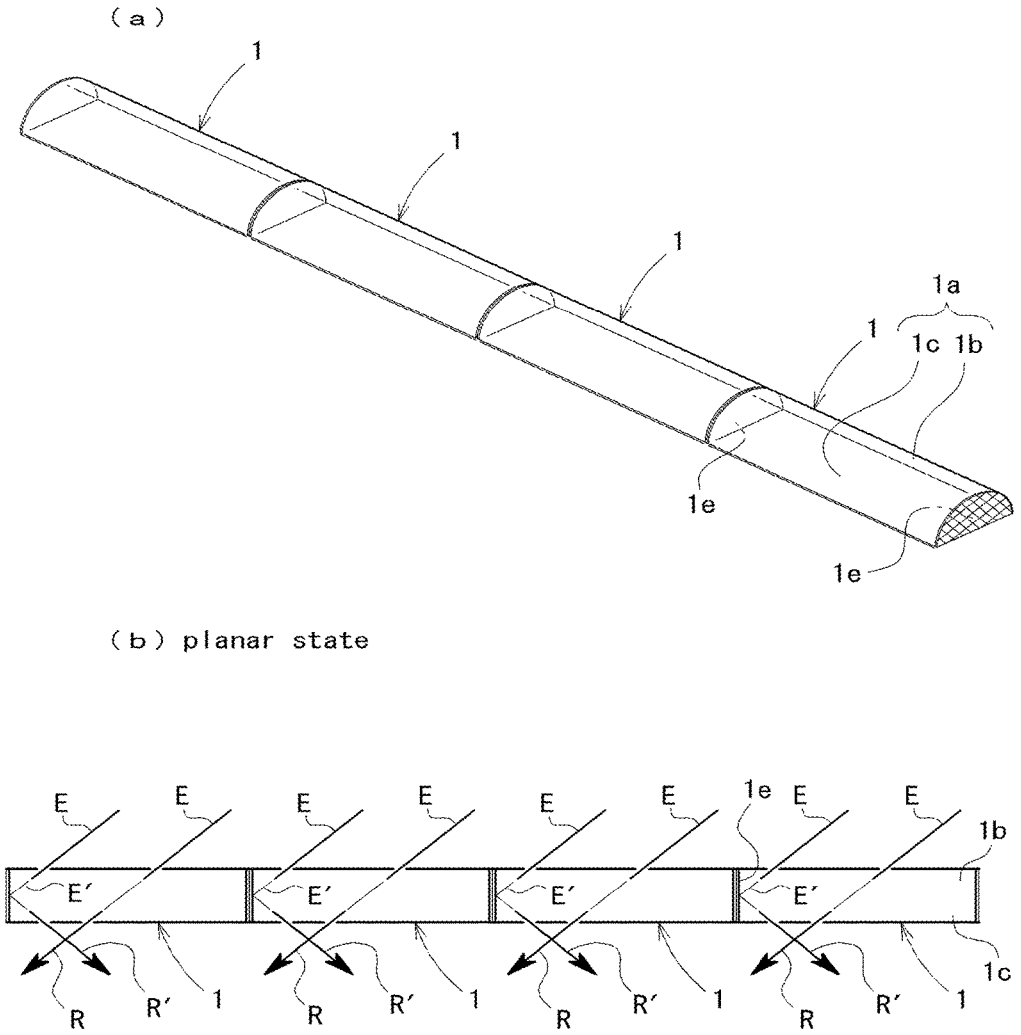
FIG. 9 is an explanatory drawing showing a daylighting structure in a form where a plurality of light-transmitting materials are connected in the longitudinal direction. (a) shows a perspective state and (b) shows a planar state.

FIG. 9 shows a daylighting structure in a form where the plurality of light-transmitting materials 1 are connected in the longitudinal direction.

In each of the light-transmitting materials 1, the refracted incident light E' that is substantially the same as that in FIG. 8 and is accompanied with the reflection effect of the orthogonal side surface 1*e*, the diffuse emission light R' corresponding to the refracted incident light E', and the like are generated.

Figure 10:
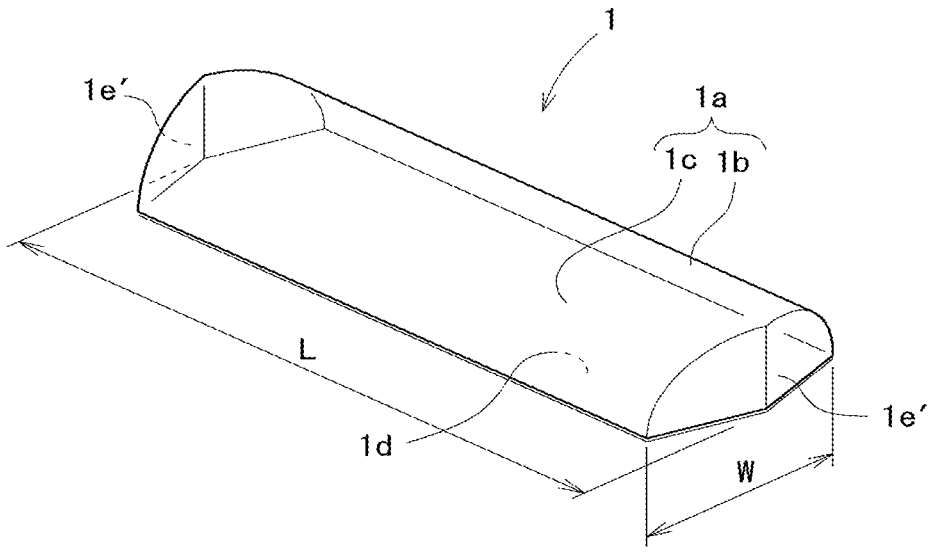
FIG. 10 is an explanatory drawing showing a light-transmitting material formed in a folded side surface that projects outward instead of the orthogonal side surface with the longitudinal direction of the light-transmitting material. (a) shows a perspective state and (b) shows a planar state.
Figure 10:
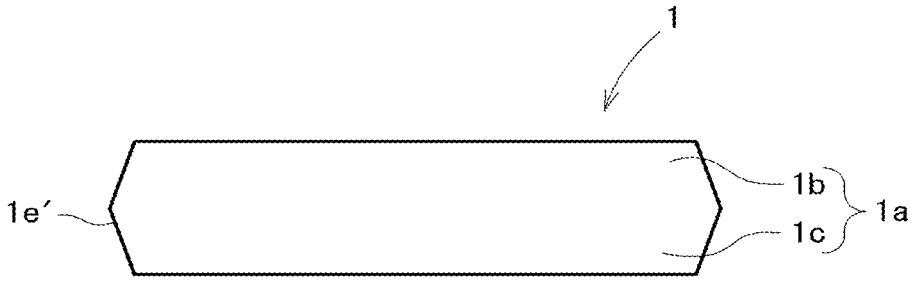

FIG. 10 shows a light-transmitting material 1 formed with the folded side surface 1*e*' that has two planer mirror surfaces and projects outward, instead of the orthogonal side surface 1*e* that is a single planer mirror surface.

Also in a case of the light-transmitting material 1 formed with the folded side surface 1*e*', the refracted incident light that is the same as that in FIG. 8 and is accompanied with the reflection effect of the folded side surface, and the diffuse emission light corresponding to the refracted incident light are generated.

The present invention is of course not limited to the embodiments described above. For example, the present invention may be configured so that

(61) as the upper side incidence and emission curved surface 1*a*, a surface of which cross section in a width direction is not a semi-circumferential surface as shown in the drawings is not used but a surface having an arbitrary curved surface shape projecting upward is used,

(62) the lower side reflection surface 1*d*, and the orthogonal side surface 1*e* and a folded side surface that are not mirror surfaces are used, and

(63) an artificial light is also included in the daylighting target.

REFERENCE SIGNS LIST

1: Light-transmitting material

1*a*: Upper side incidence and emission curved surface (1*b*+1*c*)

1*b*: Outdoor region curved surface

1*c*: Indoor region curved surface

1*d*: Lower side reflection surface

1*e*: Orthogonal side surface

1*e*': Folded side surface (see FIG. 10)

1*f*: Lateral groove part (see FIG. 6)

L: Length of the longitudinal direction (axial direction) of the light-transmitting material 1

W: Width of the lower side reflection surface 1*d* (length of a direction that is orthogonal to the longitudinal direction of the light-transmitting material)

H: Height of the light-transmitting material 1

S, T: Installation rotation direction of the light-transmitting material 1 (see FIG. 5)

D: Interval between the light-transmitting materials that are adjacent in the vertical direction (see FIG. 7)

2: Building

2*a*: Wall

2*b*: Ceiling surface

2*c*: Opening part in a horizontal direction

2*d*: High window (see FIG. 6)

2*e*: Rectangular substrate

2*f*: Laterally long hole part for attaching the light-transmitting material E: Incident light to the outdoor region curved surface 1*b*

R: Diffuse emission light from the indoor region curved surface 1*c*

E': Refracted incident light in a focused form to the orthogonal side surface 1*e* (see FIG. 8 and FIG. 9)

R': Diffuse emission light to E'

In FIG. 2

E20: Incident light of an elevation angle of 20°

E20(1): Upper end incident light beam

E20(2): Boundary incident light beam

E20(3): Lower end incident light beam

R20: Diffuse emission light area of E20

R20(1) to R20(3): Emission light beam of E20(1) to E20(3)

R20': Reflected light area (without the upper side incidence and emission curved surface 1*a*) in the lower side reflection surface 1*d* of E20

α20: Diffusion angle of R20

N1: Small crossing range of the refracted incident light "with the upper side incidence and emission curved surface 1*a*" with the lower side reflection surface 1*d*

N2: Large crossing range of the straight incident light "without the upper side incidence and emission curved surface 1*a*" with the lower side reflection surface side N3: Outward crossing range that is a part of N2 and is an indoor side outward from the lower side reflection surface 1*d*

In FIG. 3 and FIG. 5

E45: Incident light of an elevation angle of 45°

E45(1): Upper end incident light beam

E45(2): Intermediate incident light beam

E45(3): Lower end incident light beam

R45: Diffuse emission light area of E45

R45(1) to R45(3): Emission light beam of 45(1) to E45(3)

R45': Reflected light area (without the upper side incidence and emission curved surface 1*a*) in the lower side reflection surface 1*d* of E45

R45*a*: Diffuse emission light area of E45 when the light-transmitting material 1 of FIG. 3 is rotated by 10 degrees in the S direction R45*b*: Diffuse emission light area of E45 when the light-transmitting material 1 of FIG. 3 is rotated by 10 degrees in the T direction α45: Diffusion angles of R45, R45*a*, and R45*b*

In FIG. 4

E70: Incident light of an elevation angle 70°

E70(1): Upper end incident light beam

E70(2): Intermediate incident light beam

E70(3): Lower end incident light beam

R70: Diffuse emission light area of E70

R70(1) to R70(3): Emission light beam of E70(1) to E70(3)

R70': Reflected light area (without the upper side incidence and emission curved surface 1*a*) in the lower side reflection surface 1*d* of E70

α70: Diffusion angle of R70

The invention claimed is:

1. A daylighting structure formed of a light-transmitting material that is attached to a daylighting portion of a building and propagates an incident light from an outside to a ceiling surface of a building interior, the light-transmitting material comprising:

an upper side incidence and emission curved surface that is formed of an outdoor region curved surface in which the incident light is refracted and incident to the inside of the light-transmitting material in a focused form, and an indoor region curved surface from which an internally reflected light of the refracted incident light is refracted and emitted toward the ceiling surface in a diffused form, the upper side incidence and emission curved surface extending in a longitudinal direction of the light-transmitting material in a state of projecting upward from an end portion toward a center side of a width direction of the light-transmitting material;

a lower side reflection surface in which the refracted incident light reflects and changes to the internally reflected light advancing to the indoor region curved surface of the upper side incidence and emission curved surface, the lower side reflection surface extending in the longitudinal direction of the light-transmitting material; and at least one end surface of the longitudinal direction of the light-transmitting material, the at least one end surface including a mirror portion for generating the internally reflected light.

2. The daylighting structure in accordance with claim 1, wherein the upper side incidence and emission curved surface has an arc-shaped longitudinal section in the width direction of the light-transmitting material.

3. The daylighting structure in accordance with claim 1, wherein the lower side reflection surface has a mirror surface portion for generating the internally reflected light.

4. The daylighting structure in accordance with claim 1, wherein the light-transmitting material is attached to the daylighting portion in a rotatable form around a longitudinal axis thereof.

5. The daylighting structure in accordance with claim 1, wherein the daylighting portion is installed with a plurality of the light-transmitting materials facing sideways, wherein a first light-transmitting material and a second light-transmitting material installed vertically consecutive to and above the first light-transmitting material are separated by a distance of at least a predetermined value, the distance being measured between the upper side incidence and emission curved surface of the first light-transmitting material and the lower side reflection surface of the second light-transmitting material.

* * * * *